United States Patent [19]

Jenkins

[11] 4,396,189

[45] Aug. 2, 1983

[54] EXERCISING MACHINE, SKIING TEACHING MACHINE AND SKIING SIMULATOR

[76] Inventor: G. William Jenkins, 6 Thrall Ave., Rutland, Vt. 05701

[21] Appl. No.: 238,488

[22] Filed: Feb. 26, 1981

[51] Int. Cl.[3] ..... A63B 69/18

[52] U.S. Cl. ..... 272/97; 434/253

[58] Field of Search ..... 272/96, 97, 146, 130, 272/134; 128/25 R, 25 B; 434/253

[56] References Cited

U.S. PATENT DOCUMENTS

| | | | |
|---|---|---|---|
| 2,274,081 | 2/1942 | Mautin | 272/97 |
| 2,573,808 | 11/1951 | Ravoire | 272/97 |
| 3,020,046 | 2/1962 | Hotas | 272/96 |
| 3,306,626 | 2/1967 | Kawada | 272/146 X |
| 3,461,857 | 8/1969 | Poulin . | |
| 3,467,374 | 9/1969 | Auer | 272/97 |
| 3,531,110 | 9/1970 | Marchu | 272/97 |
| 3,547,434 | 12/1970 | Ossenkop | 272/97 |
| 3,582,066 | 6/1971 | Keryluk | 272/97 |
| 3,659,842 | 5/1972 | Aijala | 272/97 |
| 3,731,919 | 5/1973 | Schurch | 272/96 |
| 3,834,693 | 9/1974 | Peppenberger | 272/97 |
| 3,912,260 | 10/1975 | Rice | 272/97 |
| 4,074,903 | 2/1978 | de Aux | 272/16 |
| 4,092,787 | 6/1978 | Kampfan | 35/29 R |
| 4,306,714 | 12/1981 | Loomis | 272/96 |

OTHER PUBLICATIONS

Brochure: "Ski Boy", Alois Mayer, P.O. Box M, Norwich, VT 05055.

Brochure: "Ski V", Northeast International, 52 Tyler Row, Marblehead, MA 01945.

Brochure: "The Machine", Ken MacLeay, P.O. Box 44035, Panorama City, CA.

*Primary Examiner*—Richard J. Johnson

*Attorney, Agent, or Firm*—J.Franklin Jones, Jr.

[57] ABSTRACT

This is an exercising, skiing teaching and skiing simulating machine constructed for use at home, or in a ski shop or in any other place inside or outside of a building, at or away from the ski slopes. The machine has foot support surfaces on which a person stands which are suspended below horizontal axes of rotation. The foot support surfaces are suspended from arms pivotally mounted on a rotating platform which is supported in a floor-mounted frame. The pivots supporting the arms are vertical and are adjustable with relation to the axis of rotation of the platform. Stop pins are provided for limiting or locking rotation of the platform, and for limiting or locking the rotation of the arms. Elastic cords are also provided for applying biasing forces to the arms which create resistance to a person's motion. Sensors are also provided for sensing and signalling incorrect motions. The frame includes hand supports for the person's hands. The machine is useful for exercising and practicing skiing. Also for trying out ski boots and ski clothing. The upward offset position of the horizontal axes of rotation relative to the boot holes, toward the person's ankles, causes the ankles to be so engaged during exercises performed on the machine that the similarity of sensations to those of actual skiing is enhanced.

16 Claims, 18 Drawing Figures

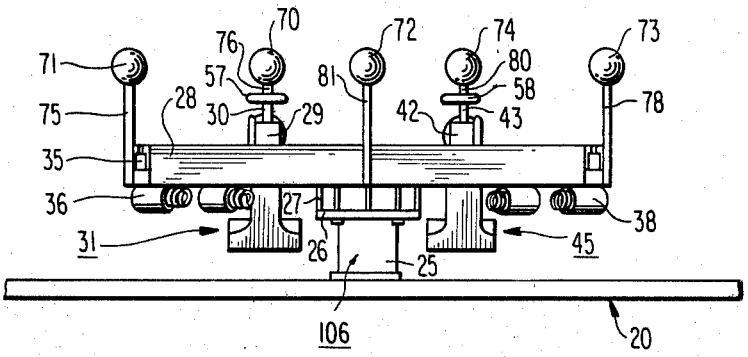
FIG. 4
FIG. 12
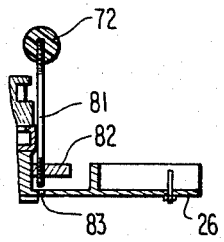
FIG. 6
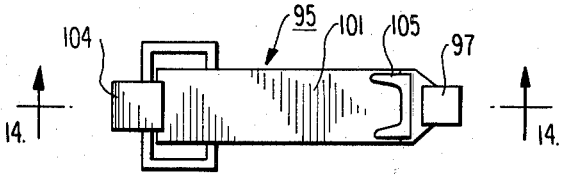
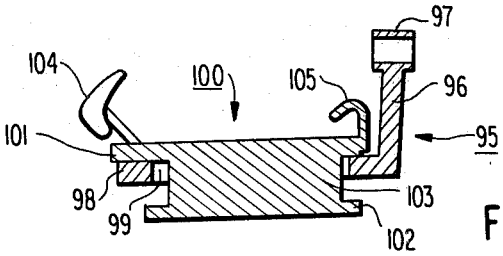
FIG. 14
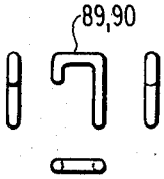
FIG. 8
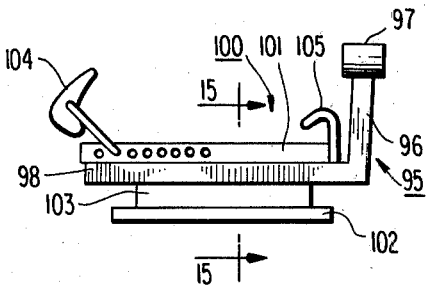
FIG. 13
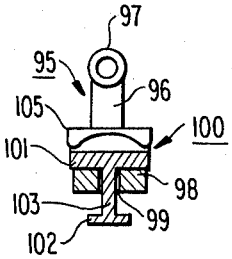
FIG. 15

FIG. 7
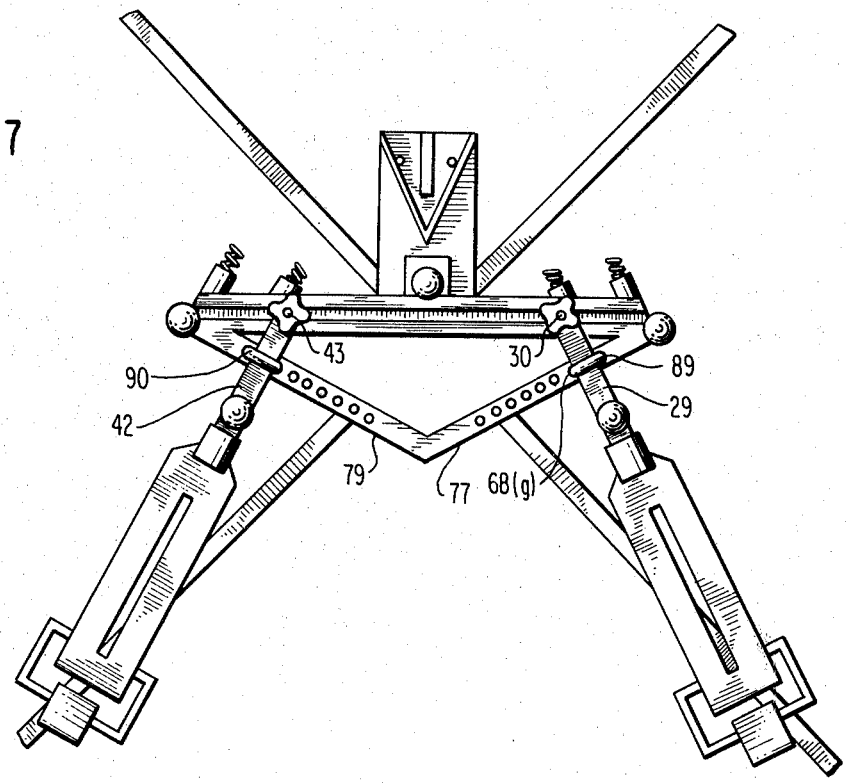
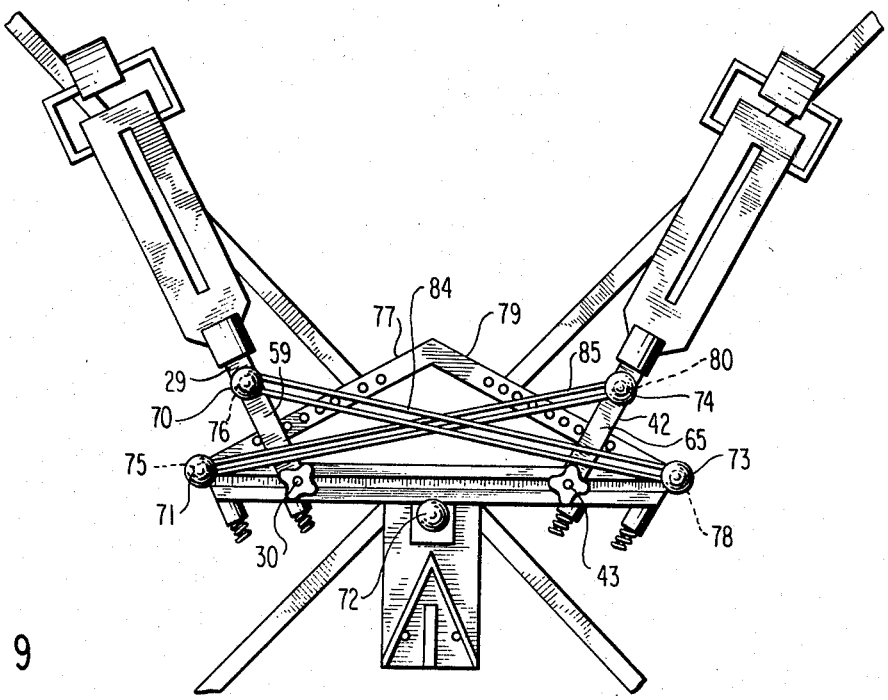
FIG. 9

EXERCISING MACHINE, SKIING TEACHING MACHINE AND SKIING SIMULATOR

My invention is an exercising machine, skiing teaching machine and skiing simulator. My invention is also a physical therapy machine which is adapted to the strengthening of the muscles and joints of a person, and the refinement of the sense of timing and of balance of a person.

My invention is useful for skiing teaching by ski schools, for testing and demonstrating ski boots and ski clothing, in ski shops and for personal exercising at home. It is useful for exercising by people who desire to strengthen the muscles in their legs, hips, and torso. It provides a safe, efficient means for testing and improving the sense of timing and balance of a person who uses it.

A machine constructed in accordance with the principles shown in the embodiment of my invention, described in the following specifications, will be especially adapted to the mechanical, physical and mental structures of a person.

I have made findings about the bio-mechanics and about the reflexes and habits of muscle responses of people. I have applied these findings to the development of my invention. By analyzing the principles which I have found and by constructing a machine in accordance with these principles, I have invented an improved exercising machine and skiing simulator.

People who desire to ski, whether they are experts or beginners, usually wish to become more proficient. The opportunity to practice skiing, and to learn to ski by actually skiing, is limited by weather conditions, geography, and the time available. People who want to ski, frequently wish for a means to practice and learn at home; in the summertime, or in places far from ski areas.

I have invented a means, to learn to ski and to practice skiing even when local conditions are such that actual skiing is not possible.

Some athletic activities are very similar to skiing. Some are only partly similar. The body motions and positions required in such athletic activities will be largely or partly similar to those of skiing. Timing of the body, leg and arm motions, balance, reflexes, responses to shifts of weight or position are similar. While my machine is especially adapted to the teaching of skiing, the simulation of skiing, and the physical and psychological development of persons who desire to ski, it is also well suited to be used for physical and psychological development of people who may have no desire to ski.

Previous to my invention, there have been other skiing simulators. None of these other skiing simulating machines has been as complete or as adequate in providing for the many complex physical and psychological elements of skiing, as is the machine which I have invented.

An important part of the human orthopedic structure is the ankle joint. This has not been perceived by the inventors of the prior skiing simulating machines, nor has it been made a part of the prior machines.

Prior machines have been only partly effective because they have not been constructed in a way which accounts for ankle joint motions in the manner which I provide in my invention. My invention is constructed in a way which provides for motions of feet, ankles, legs, knees, thighs, lower body, waist, upper body, arms and head of a person that effectively approximates the motions that a person must make when actually skiing. Also my invention is constructed to cause restraints to the motions of a person which closely duplicate the restraints that a skier is subject to while skiing.

Some prior skiing teaching machines and skiing simulators have provided means for a person to rotate his body, or feet, around axes which are substantially vertical.

Other previous skiing teaching machines and skiing simulators have included means for allowing the user to rotate each foot around an approximately horizontal axis lying in a plane at the level of the boot sole. In yet other machines, the horizontal axis of rotation for each foot lies below the boot sole.

I have found that it is desireable in a skiing teaching machine and skiing simulator to provide for the part that a person's ankle joints play in the dynamics of skiing. When lateral rotation of an ankle joint occurs, there is a physical sensation, which may not be consciously recognized, that is an important part of the skiing experience.

The integration of all the sense stimulii including ankle joint sensations results in the feeling of skiing by a person using my machine. I have found that it is desireable to provide axes of rotation that pass approximately through the ankles of the user, in a front to rear direction, in order to provide an experience that simulates skiing.

The importance of providing a horizontal axis of rotation passing approximately through each ankle of the user, in a front to back direction is related mechanically to the physical structure of a persons' bones and joints. Also it is related to the psychological factors of reflex actions, sense stimulii, and responses that a person has grown accustomed to during his or her life of using, and responding to ankle motions.

Because skiing motions are quickly made, and because the relative positions of a skier's arms, legs, feet, body and head change from moment to moment, it is difficult to determine whether they are correct. As a part of my invention, I include means for detecting and indicating the correctness of these motions and positions.

THE DRAWINGS

My invention is disclosed in the following description by means of several drawings of a preferred embodiment of my skiing teaching machine and skiing simulator. The drawings are accompanied by a detailed description.

FIG. 4 is a front elevation of the embodiment.

FIG. 6 is a part section of a portion of the embodiment of FIG. 3 taken in split plane 6—6.

FIG. 7 is a plan view of my invention showing a particular locking arrangement of some of the components.

FIG. 8 shows a detail of a locking pin, such as is shown in FIG. 7.

FIG. 9 is a plan view showing a biasing arrangement.

FIGS. 12, 13, 14, and 15 are views of a foot support member that includes means that permit lifting of the user's foot and for moving the foot forward and backward within a limited distance.

FIG. 12 is a plan view.

FIG. 13 is a side elevation.

FIG. 14, is a section of FIG. 12.

FIG. 15 is a section of FIG. 13.

Figure 16:
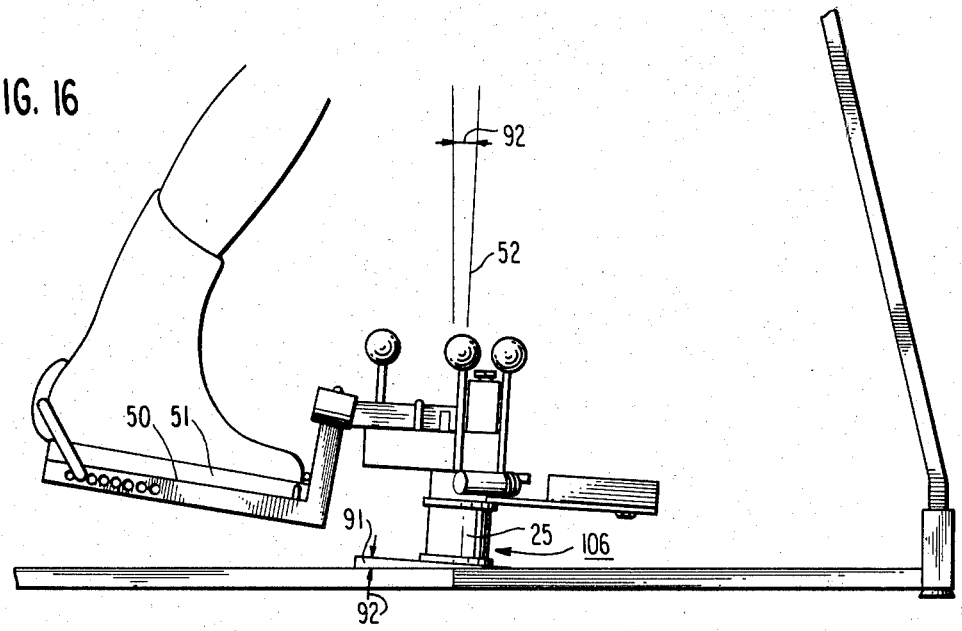

FIG. 16 is a right side elevation of a modification of my invention wherein the vertical axis of rotation of the rotating platform is inclined upwardly toward the front.

Figure 17:
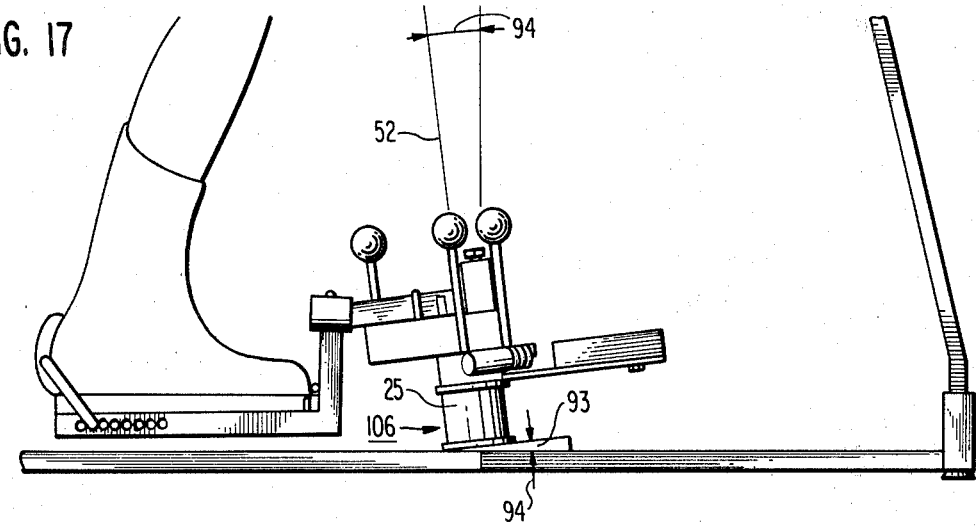

FIG. 17 is a right side elevation of a modification of my invention wherein the vertical axis of rotation of the rotating platform is inclined upwardly toward the rear.

Figure 18:
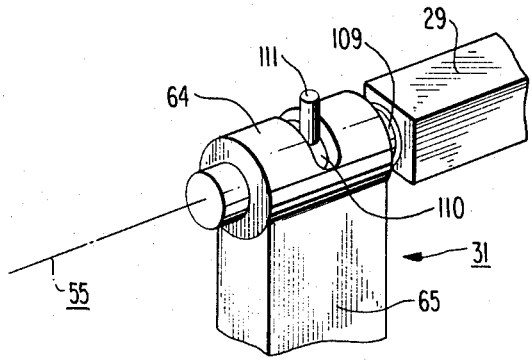

FIG. 18 is a view showing details of the rotatable connection between right side arm and right foot support member.

Having listed the Figures that are being used to describe the embodiments of my invention, I will now describe in detail the construction of my invention and the function of the parts. The embodiment that is described here is one of a number of equivalent embodiments that may be made within the spirit of my invention.

DETAILED DESCRIPTION

I now refer to the drawings of the preferred embodiment of my invention. As I describe the details of the embodiment, I will refer to numbers which appear on the drawings which identify the individual elements of the embodiment, and which identify particular portions or features of the parts.

Figure 1:
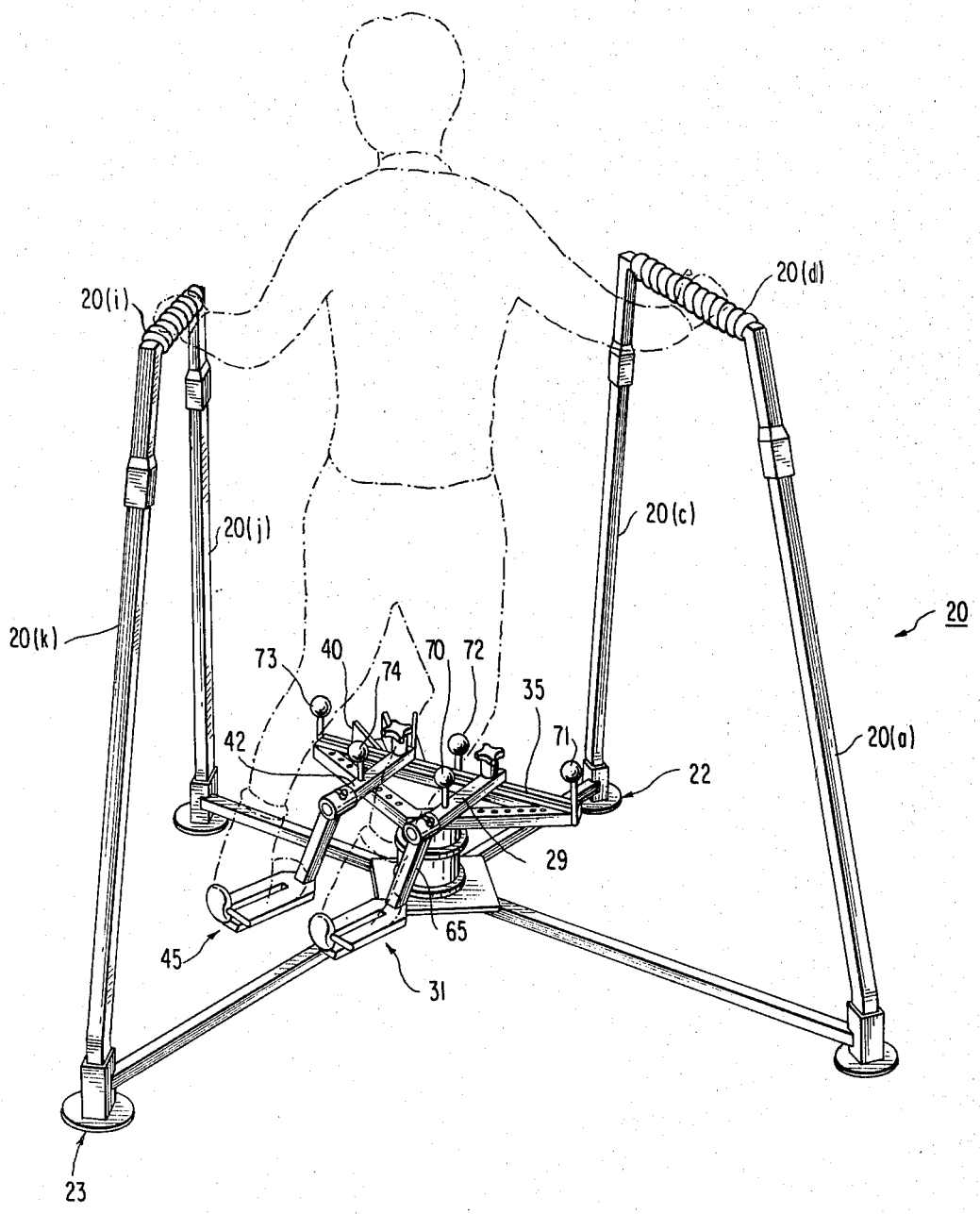
FIG. 1 is a front, top and side perspective view of my skiing teaching machine.

FIG. 1 is a drawing showing in perspective the preferred embodiment which I will describe in this specification. Although many of the element numbers appear in FIG. 1, I will be describing the embodiment by making reference to the element numbers shown in FIGS. 2 through 18. Any number found in several of the Figures will be referring to the same part.

Figure 2:
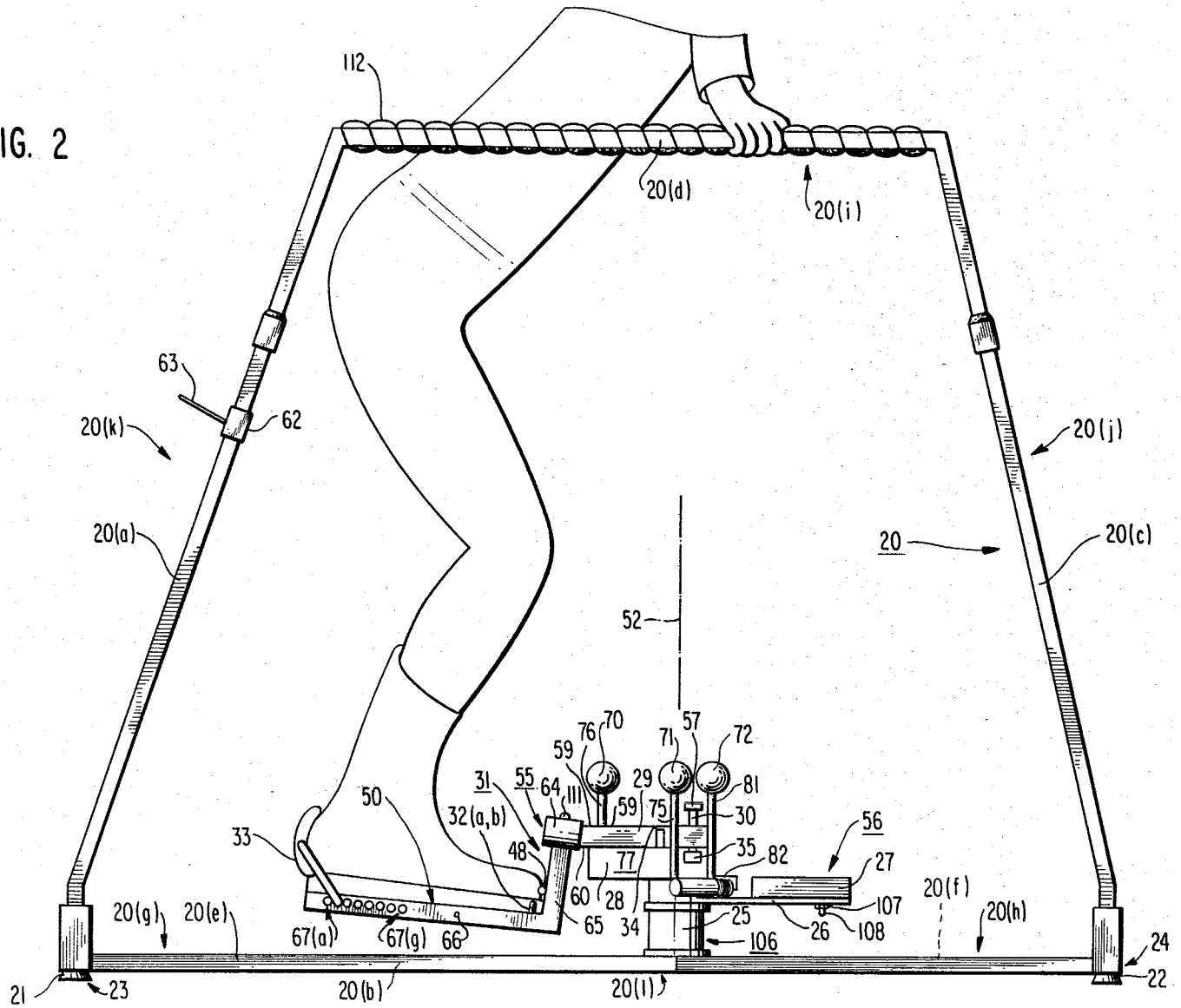
FIG. 2 is a right side elevation of the embodiment of my invention.
Figure 3:
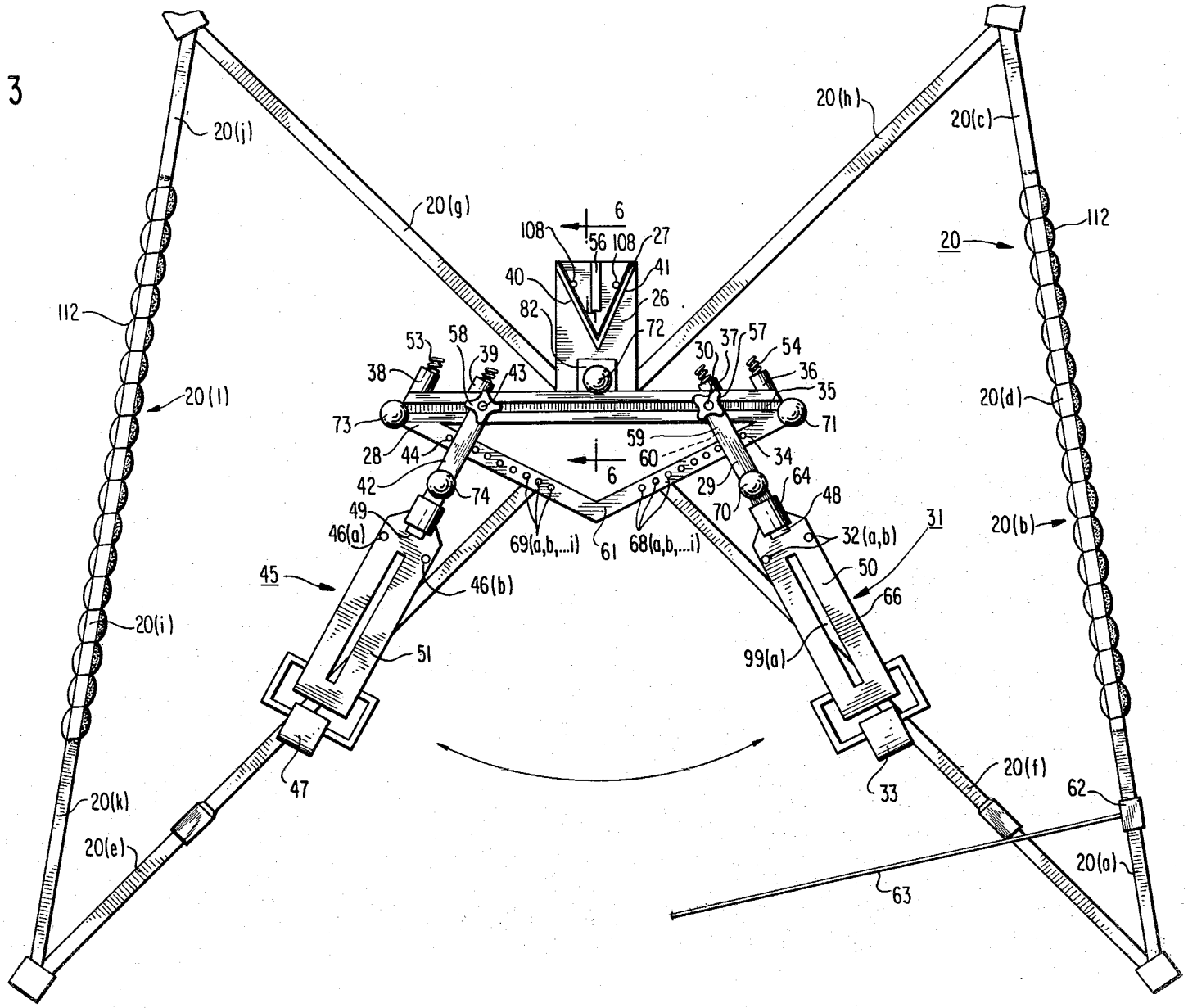
FIG. 3 is a top view of the embodiment of my invention.

FIG. 2 is a side elevation of an embodiment of my invention. A frame 20 is made of a number of individual members which are rigidly assembled together. Certain of the individual members of frame 20, namely 29(*a*), 20(*b*), 20(*c*), 20(*d*) are shown in FIG. 2. Indicated, but not shown in FIG. 2 are members 20(*e*), 20(*f*), 20(*g*), 20(*h*), 20(*i*) 20(*j*), 20(*k*), and 20(*l*). Other members of frame 20 which are not shown in FIG. 2 will appear in other Figures which portray the embodiment. The frame 20, in use, will stand upon four feet, two of which are shown in FIG. 2 as foot 21 and foot 22. Indicated in FIG. 2 are the other two feet, foot 23 and foot 24. The feet 21, 22, 23, 24 may be made in form of rubber suction cups that will hold the frame 20 firmly in position on the floor while the machine is being used by a person. A vertical spindle housing 25 is securely fastened to the frame at the place where frame members 20(*e*), 20(*f*), 20(*g*), and 20(*h*), as shown in FIG. 3, are mutually joined together. Contained in vertical spindle housing 25 is a vertical spindle 106. The axis of rotation of vertical spindle 106 is represented by line 52 in the embodiment shown in FIG. 2. Vertical spindle 106 is not portrayed in FIG. 2 because it is contained within the vertical spindle housing 25. Vertical spindle 106 is rotatably mounted in appropriate radial and thrust bearings. A horizontal arm 26 is securely fastened to vertical spindle housing 25. A "V" shaped stop 27 is fastened by nuts 107 and studs 108 to horizontal arm 26. "V" shaped stop 27 serves to limit the amount of rotation of the vertical spindle 106 as will be described below. A flat stop 56 is indicated on FIG. 2. Flat stop 56 is securely attached to horizontal arm 26.

A rotating platform 28 is securely attached to the top end of the vertical spindle 106. Rotating platform 28 is freely rotatable about the vertical axis 52 of the vertical spindle 106, but within the limits which are defined by "V" shaped stop 27 in cooperation with other components, as will be described below.

A "T" slot 35 lies in the top face of rotating platform 28. The "T" slot 35 is horizontal, is open at the top and extends for the full width of rotating platform 28.

Mounted in "T" slot 35 by means of its appropriately shaped head portion is a "T" bolt vertical pivot 30. "T" bolt vertical pivot 30 is slideably horizontally adjustable in "T" slot 35. A hand nut 57 may be turned to lock the "T" bolt vertical pivot 30 in a selected horizontal position.

A right side arm 29 is attached to rotating platform 28 by means of "T" bolt vertical pivot 30 so that right side arm 29 is freely rotatable about a vertical axis which is defined by the centerline of "T" bolt vertical pivot 30. The angle through which right side arm 29 is rotatable is limited by stops which will be described in more detail in the description of FIGS. 3 and 7.

A right foot support member 31 is rotatably connected to the end of right side arm 29 opposite the end where right side arm 29 is rotatably joined with "T" bolt vertical pivot 30.

The rotatable connection between right side arm 29 and right foot support member 31, is shown in detail in FIG. 18. This rotatable connection is comprised of a cylindrical hole in hub portion 64 of right foot support member 31, a cylindrical end portion 109 of right side arm 29, as shown in FIG. 18, and other associated elements as will be described here. A pin 111 is attached to cylindrical end portion 109 engages an arcuate slot 110 in hub portion 64. This pin 111 allows limited rotation of the hub portion 64 but restrains axial motion of hub portion 64 with respect to cylindrical end portion 109.

The axis 55 around which right foot support member 31 is rotatable, is generally parallel or nearly so with the longitudinal center line of right side arm 29. A portion of right foot support member 31 is the boot support surface 50. Boot support surface 50 is flat and is approximately parallel with axis 55. In order to accomplish one of the important purposes of my invention, the surface 50 is displaced vertically downwardly a distance from axis 55 so that when a person is standing with his or her right boot sole in contact with surface 50, the projection of axis 55 will pass approximately through his or her ankle. The vertically downward displacement of boot support surface 50 from axis 55 will be called the "offset."

The physical dimensions of different people are different. The exact amount of "offset" required for one person will differ from that for another. I have found that an average amount of the "offset" will serve to make my invention effective. For great precision, the amount of the "offset" may be adjusted by spacers between boot sole and surface 50, but for practical purposes, the use of spacers is not necessary. I have found that for usual purposes the amount of "offset" should be approximately five inches. I have also found, however, that amount of "offset" of as little as one-half inch, or as great as ten inches will be desireable in some cases, for some purposes.

I have found that the effects that are produced by different ski boots can be related to the amount of "offset," in so far as the physical and sense experiences of a user of my machine is concerned.

Attached to right foot support member 31 are right boot toe stops 32(*a*) and 32(*b*), right boot toe lock 48 and right boot heel clamp 33.

Portions of frame 20 identified as 20(*d*) and by 20(*i*) are hand rails. These portions 20(*d*) and 20(*i*) are at approximately waist height of a person using my machine. These hand rails may be grasped by the user in order to stabilize himself. These hand rails may be padded for protection of the user's body 112.

Attached to the diagonally vertical portion 20(*a*) of frame 20 is sensor 62 to which is attached wand 63. Placement of the sensor 62 and the wand 63 is such that improper motions of a user of my machine will be detected and signalled. The positions of sensor 62 and the wand 63 are respectively adjustable for people of different sizes or for the detection of different positions and motions of the users' body. The wand 63 is pivotally attached to the sensor 62 so that the wand will rotatably swing about an axis whose orientation has been established for a direction appropriate for the measurement that is desired. Several sensors with wands may be used at one time to measure combinations of motions and positions. When several sensors with wands are used, they will be respectively positioned in several locations so that each sensor and wand registers a different body position or motion.

FIG. 3 is a plan view of the embodiment shown in FIG. 2 of my invention. Frame 20 is shown to include frame portions 20(*a*), 20(*c*), 20(*d*), 20(*e*), 20(*f*), 20(*g*), 20(*h*), 20(*i*), 20(*j*), and 20(*k*). Also frame portions 20(*b*) and 20(*l*), which are hidden from view are indicated. Portion 20(*d*) of frame 20 is the right-hand hand rail, and portion 20(*i*) is the left-hand hand rail. The portions of frame 20, which are identified as 20(*b*), 20(*e*), 20(*f*), 20(*g*), 20(*h*), and 20(*l*) lie in common horizontal plane, approximately one and one-half inches from the floor. These portions are above the floor by the vertical height of the feet 21, 22, 23 and 24, which are shown in FIG. 2. The portions of the frame 20, which are identified in FIG. 3 as 20(*a*), 20(*c*), 20(*j*), and 20(*k*) slope diagonally vertically. Portions of frame 20, which are identified in FIG. 3 as 20(*d*) and 20(*i*) lie in a common horizontal plane, which is located approximately fortyfive inches from floor level.

Attached to rotating platform 28 are outer right stop 36 and outer left stop 38, also inner right stop 37 and inner left stop 39. Also shown are outer right stop cushion spring 54 and outer left stop cushion spring 53. These cushion springs function as energy absorbers and rebound creators when rotating platform 28 is rotated sufficiently far in one direction or the other so that outer right stop cushion spring 54 or outer left stop cushion spring 53 comes in contact with flat face 41 or flat face 40, respectively. Inner right stop 37 and inner left stop 39 may also carry cushion springs, thus providing for different degrees of cushion and rebound. When a larger amount of free rotation of rotating platform 28 is desired than is permitted by the "V" shaped stop 27, this "V" shaped stop 27 may be removed from horizontal arm 26 and then limit stop 56 will define the maximum possible angles through which rotating platform 28 can rotate from its central position in each direction. Rotating platform 28, as shown in FIG. 3, is in the central position, rotationally, of its possible motion.

The construction of the embodiment of my invention that is described here is such that many of the components include right hand elements and left hand elements. FIG. 3 portrays, in addition to the right hand parts previously described, a number of left hand parts including "T" bolt vertical pivot 43, hand nut 58 and left side arm 42. A portion of the following description which refers to right side or right hand parts will be seen to also apply to left hand or left side parts.

Right side arm 29 is rotatable around a vertical axis defined by the centerline of "T" bolt vertical pivot 30, but the angle through which it may rotate is limited, in the counter clockwise direction, by stop pin 34. In a clockwise direction, the rotation of right side arm 29 will be limited by its interference with left side arm 42.

Rotation of left side arm 42 is limited, in the clockwise direction of rotation by stop pin 44.

Right side arm 29 is approximately square in cross section. Its top face 59 and bottom face 60 are flat. The bottom face 60 of right side arm 29 is supported by the top face 61 of rotating platform 28. Rotation of right side arm 29 causes bottom face 60 of right side arm 29 to slide on top face 61 of rotating platform 28.

The rotational position of right side arm 29 as shown in FIG. 3 is fully counter clockwise, because right side arm 29 is in contact with stop pin 34. The rotational position of left side arm 42 is shown to be fully clockwise, because left side arm 42 is shown to be in contact with stop pin 44.

Figure 5:
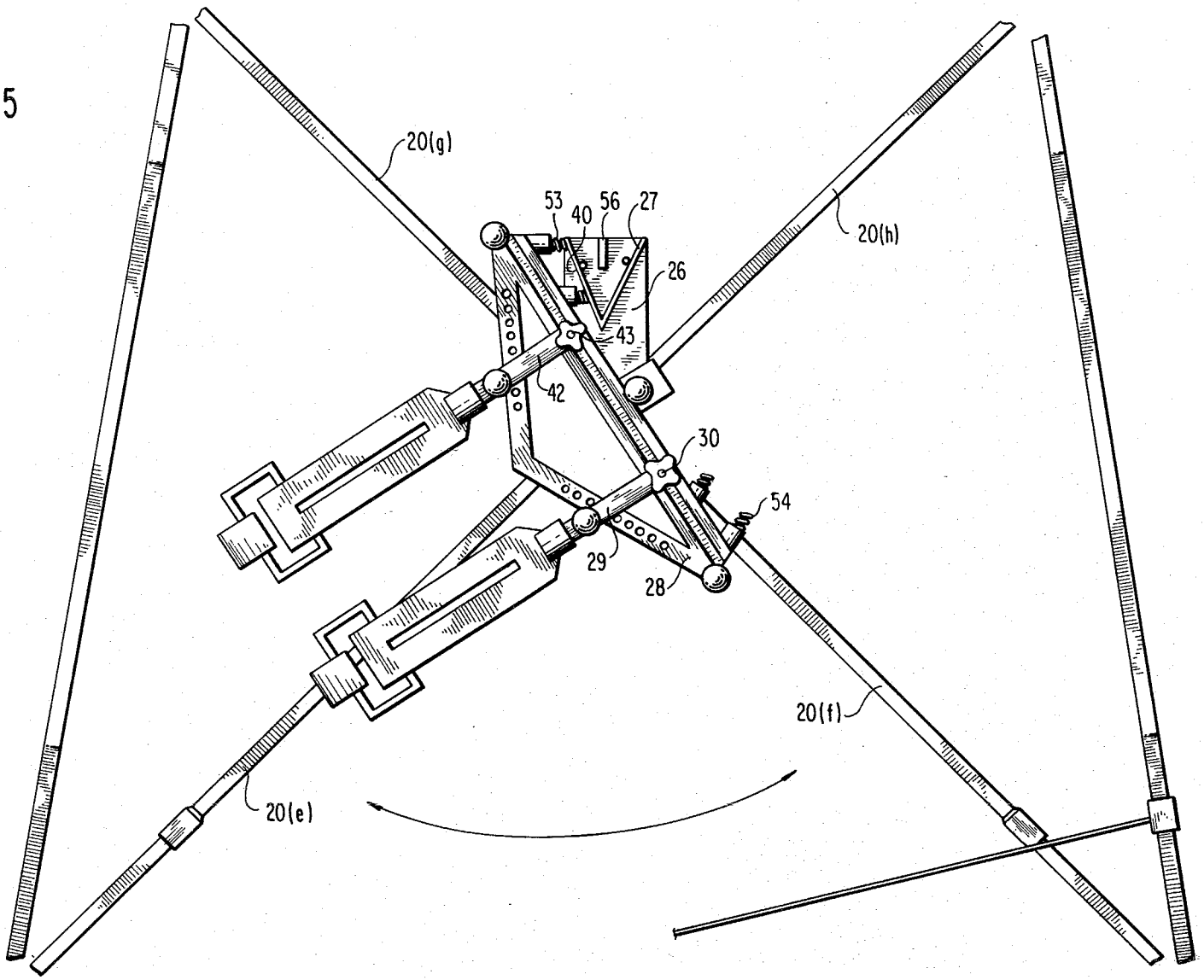
FIG. 5 is a top view of the embodiment of my invention, wherein several of the components of the embodiment are shown moved into new positions from those shown in FIG. 3.
Figure 11:
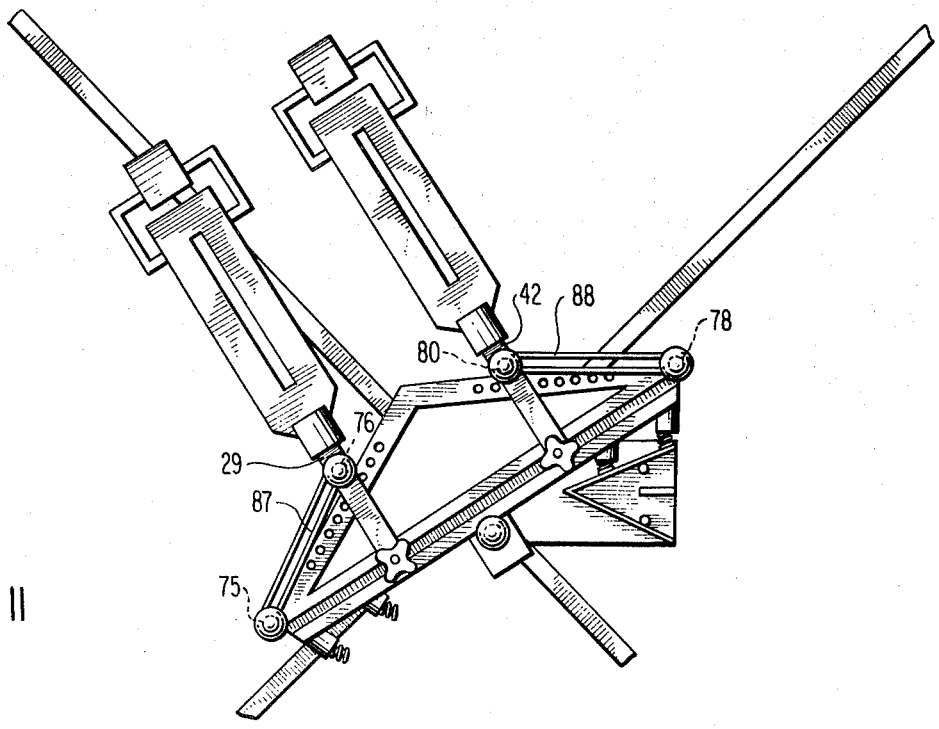
FIG. 11 is a plan view showing a third biasing arrangement.

The rotational positions of right side arm 29 and left side arm 42 as shown in FIG. 3, are characteristic of their positions when the user of my machine is simulating a "snow plow" turn or a "stem" turn while skiing. "Snow plow" turns and "stem" turns are performed when a skier places his two skis in a "V" shaped pattern with the (front) tips of the skis close to each other and the (rear) tails of the skis widely separated. The apex of the "V" is at the front of the skis. Also many of the exercise and simulated maneuvers that a user of my invention may make will result in the relative positions of right side arm 29 and left side arm 42 being parallel with each other as shown in FIGS. 5 and 11.

Reference is now made to FIG. 2 along with FIG. 3. Right foot support member 31 consists of several portions which include a shoe plate 66 having a flat surface 50, a perpendicular bracket 65 attached to the shoe plate 66 and a hub 64 attached to the end of the perpendicular bracket 65 opposite to the end to which is attached to the shoe plate 66. The length of perpendicular bracket 65 defines the amount of offset of surface 50 from axis of rotation 55.

During the time that a person is using my machine, he or she will stand upon surface 50 of right foot support member 31, and corresponding surface 51 of left foot support member 45.

Attached to right foot support member 31 are toe stops 32(*a*) and 32(*b*). Toe stops 32(*a*) and 32(*b*) are cylindrical elements approximately one inch long that are attached to surface 50 and are perpendicular to surface 50, and are spaced apart by a distance so that the toe of the users boot will fit between them. Correspondingly, toe stops 46(*a*) and 46(*b*) are attached to left foot support member 45.

Right boot toe lock 48 is attached to perpendicular bracket 65 of right foot support member 31. Right boot toe lock 48 is a cylindrical part approximately one inch long that is fastened in place, parallel to surface 50 at a distance from surface 50 that will allow the toe of the boot of the user to fit under right boot toe lock 48 with minimal clearance. Right boot toe lock 48 serves to hold the toe of the boot of the user from being lifted away from surface 50.

Corresponding to right boot toe lock 48, but attached to left foot support member 45, is a left boot toe lock 49.

A right boot heel clamp 33 is attached to the shoe plate 66 portion of right foot support member 31 at the end opposite from the junction of shoe plate 66 and perpendicular bracket 65. The attachment means for joining right boot heel clamp 33 to shoe plate 66 includes a row of holes 67(*a*), (*b*), (*c*), (*d*), (*e*), (*f*), (*g*). Multiple holes allow for the clamping of different size boots. Hole 67(*a*) will be used for a large boot and 67(*g*) for a much smaller boot. A corresponding left boot heel clamp 47 attached to left foot support member 45 is provided for the left foot and boot of the user.

Stop pin 34, which limits the rotation of right side arm 29 is cylindrical and is attached to rotating platform 28 by being inserted into one of a series of holes 68(*a*,) (*b*) . . . (*i*), which are drilled into surface 61 of rotating platform 28. The stop pin 34 is shown in FIG. 3 to be inserted in hole 68(*i*). Multiple positions of location of stop pin 34 are possible by selection of the hole, 68(*a*), (*b*) . . . (*i*) into which stop pin 34 is inserted.

Corresponding with holes 68 are holes 69(*a*), (*b*) . . . (*i*) into which may be inserted stop pin 44 in order to limit the angle of rotation of left side arm 42.

FIG. 5 is a plan view in which is shown a different set of position of the components of the embodiment of the machine which is shown in FIG. 3. In FIG. 5, rotating platform 28 is shown to be fully rotated in clockwise direction so that cushion stop spring 53 is in contact with flat face 40 of "V" shaped stop 27. Also "T" bolt vertical pivot 30 and "T" bolt vertical pivot 43 are shown to be in different positions of adjustment. Right side arm 29 and left side arm 42, are shown to be parallel with each other.

In FIG. 2, spherical knob 72 is seen to be attached to the upper end of threaded rod 81. The lower end of threaded rod 81 is threaded and is contained in a threaded hole that passes through projection 82 of FIG. 3. Projection 82 is securely attached to rotating platform 28.

Reference is here made to FIG. 6, which is a cross section view taken from FIG. 3. Threaded rod 81 fits a threaded hole in projection 82.

A hole 83 is located in the horizontal arm 26. This hole has a diameter slightly larger than the lower end of threaded rod 81. The lower end of threaded rod 81 is cylindrical. Hole 83 is located so that the cylindrical lower end of threaded rod 81 will engage the hole 83 when rotating platform 28 is in its mid position of rotation and when threaded rod 81 is fully advanced downwardly. Engagement of the lower end of threaded rod 81 with hole 83 will lock rotating platform 28 from rotating in either direction. FIGS. 3, 7, 9, and 10 show rotating platform 28 in its mid position. Holes other than 83 may be provided for locking rotating platform 28 in other positions.

FIG. 4 is a front elevation of part of the embodiment being described and it may here be referred to for a clearer understanding of my invention. Many of the component numbers which are referred to in the following paragraphs will be found in FIG. 4.

Plan view, FIG. 9, shows the parts in the same relative positions as in FIG. 3 with additional parts.

The additional parts which will now be described serve to cause biasing forces to be applied to right side arm 29 and left side arm 42 tending to cause rotation of the side arms respectively around "T" bolt vertical pivots 30 and 43.

Spherical knob 71, also shown in FIG. 2, is attached to the upper end of cylindrical rod 75. Cylindrical rod 75 is securely attached to the vertical face 77 of rotating platform 28. Spherical knob 70, also shown in FIG. 2, is attached to one end of cylindrical rod 76. Cylindrical rod 76 is securely attached to the top face 59 of right side arm 29.

Spherical knob 71 and its associated parts are on the right side of rotating platform 28. On the left side of rotating platform 28 there are corresponding parts consisting of spherical knob 73 and cylindrical rod 78. Cylindrical rod 78 is securely attached to vertical face 79 of rotating platform 29.

Spherical knob 74 and cylindrical rod 80, attached to left side arm 42 correspond to spherical knob 70 and cylindrical rod 76.

It is sometimes desired, when using my machine for certain exercises to apply forces that will cause side arms 29 and 42 to be urged to rotate in one direction or the other direction around "T" bolt vertical pivots 30 and 43.

FIG. 9 shows an arrangement for applying forces that will tend to cause rotation of right side arm 29 in a clockwise direction and rotation of left side arm 42 in a counter clockwise direction. Elastic cord 84 is engaged between cylindrical rod 78 and cylindrical rod 76 thus applying rotational clockwise force to right side arm 29.

A corresponding elastic cord 85 is engaged between cylindrical rod 75 and cylindrical rod 80, applying a counter clockwise force to left side arm 42. Elastic cords 84 and 85 may be made of material that is called airplane cord or shock cord. The forces produced by elastic cords 84 and 85 have beneficial effects for exercise and timing responses of the user. Forces applied to right side arm 29 and to left side arm 42 are respectively independent of each other when the arrangement of FIG. 9 is used.

Figure 10:
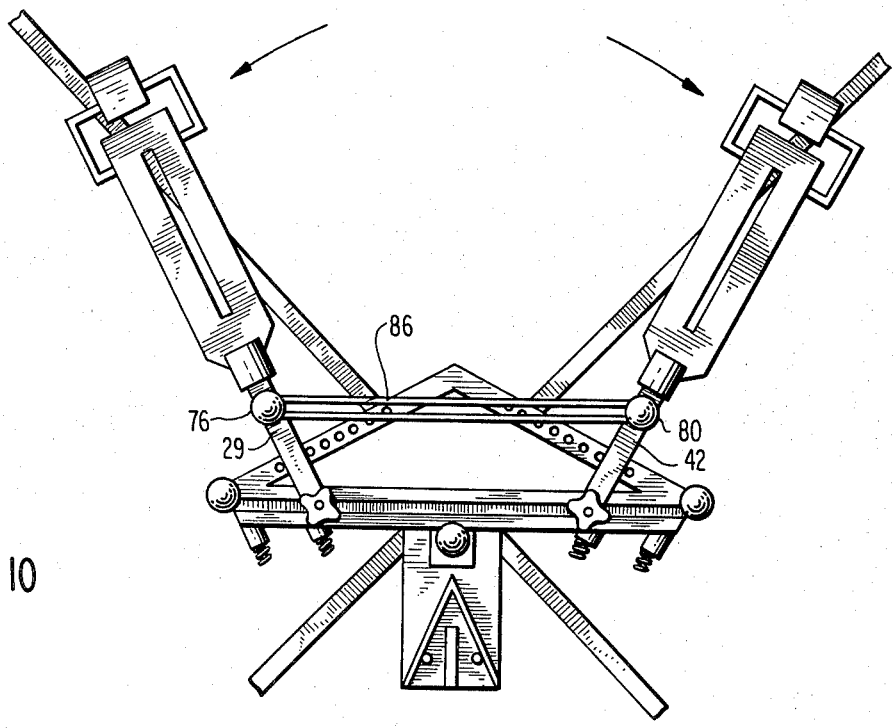
FIG. 10 is a plan view showing a second biasing arrangement.

FIG. 10 shows an elastic cord attached between cylindrical rod 76 and cylindrical rod 80. This elastic cord 86 will cause right side arm 29 and left side arm 42 to be urged in directions toward each other.

FIG. 11 shows elastic cord 87 connected between cylindrical rod 75 and cylindrical rod 76, causing a biasing force tending to rotate right side arm 29 in a counter clockwise direction. Elastic cord 88, which is connected between cylindrical rod 78 and cylindrical rod 80, will cause a biasing force that tends to make left side arm 42 rotate in a clockwise direction.

In FIG. 7, a "J" shaped locking pin 89 is shown to be installed in hole 68(*g*) so that it engages right side arm 29 in such a way that right side arm 29 is restrained from rotating in either direction about the vertical axis defined by "T" bolt vertical pivot 30. It may be seen that selection of a different hole 68 or a different adjustment position of "T" bolt vertical pivot 30 will cause right side arm 29 to be locked in a different position. "J"

shaped locking pin 90 is shown in FIG. 7 to be securing left side arm 42 so that it is restrained from rotating about the axis defined by "T" bolt vertical pivot 43.

FIG. 8 is a detail drawing of the two "J" shaped locking pins 89 and 90. The "J" shaped locking pins may be manufactured from round metal rod cut to length and bent into the shape shown.

FIG. 16 shows a different embodiment of my invention. Wedge shaped shim 91 is shown in FIG. 16 to be installed under vertical spindle housing 25, thus causing axis of rotation 52 of vertical spindle 106 to be inclined forwardly from a vertical alignment by an angle equal to the angle 92 of wedge shaped shim 91. The inclination of the axis of rotation 52 of the vertical spindle 106 will change the function of the machine because the function depends partly on gravity. A user of my machine will experience different results because of the inclination. The amount of difference in the results will depend upon the amount of inclination.

FIG. 17 shows another embodiment of my invention. Wedge shaped shim 93 having angle 94 is installed under vertical spindle housing 25 in such a way that axis of rotation 52 is inclined vertically toward the rear of the user.

It will be seen when axis of rotation 52 is inclined forward as shown in FIG. 16 that the user will be required to use skill and agility to keep the rotating platform 28 and hence himself, from swinging to rest in one extreme position or the other extreme position of rotation of rotating platform 28.

By contrast, when the axis of rotation 52 is inclined as shown in FIG. 17, the rotating platform 28 and hence the user, will tend to move toward the central rotational position of rotating platform 28. The skill required in order to successfully perform exercises on my machine will be much less when the configuration of FIG. 17 is used, as compared with the amount of skill required when the user is using my machine as shown in the configuration of FIG. 16.

Sometimes a skier of advanced skill will, when skiing, perform certain motions with his or her feet as he or she progresses through a series of turns. He or she may move his or her feet back and forth with respect to one another. One foot will be placed slightly ahead of the other foot as a turn is initiated. This action is called "change of lead" by skiers.

Also, as a series of turns are being executed, a skier of advanced skill may raise one foot or the other foot a slight amount, keeping the ski of the raised foot approximately parallel with the surface of the snow. The raised ski will be held approximately parallel with the other ski. It is frequently important that the parallelism of the two skis be maintained.

It is sometimes desireable to lift one end of the raised ski a slightly different amount as compared with the amount that the opposite end is lifted.

In order to permit "change of lead" and to permit the slight amount of lifting of a foot when a person is using my skiing teaching machine and skiing simulator, I have included the following described construction.

I call attention to shoe plate 66 of FIGS. 2 and 3, which is a part of right foot support member 31.

It is seen that right foot support member 31 consists of perpendicular bracket 65, hub 64, shoe plate 66 and that toe stops 32(*a*) and 32(*b*) are attached to shoe plate 66, that right boot toe lock 48 is attached to perpendicular bracket 65, and that right boot heel clamp 33 is attached to shoe plate 66 by means of one of a group of holes 67(*a*), (*b*) . . . (*g*).

Attention is now directed to FIGS. 12, 13, 14, and 15.

FIGS. 12 and 13 are respectively top and side views of a foot support member 95 which is constructed in a manner that will permit relative motion between the users foot and the foot support member 95 both in a longitudinal, planear direction and in a vertical, planear direction within limited distances.

FIG. 14 is a cross section taken in plane 14—14 of FIG. 12. FIG. 15 is a cross section taken in plane 15—15 of FIG. 13.

The design shown by FIGS. 12 and 13, also by sectional views 14 and 15 of foot support member 95 includes perpendicular bracket 96, hub 97 and foot plate 98.

Foot plate 98 contains a slot 99, which may be seen in FIGS. 14 and 15. A similar slot is seen in shoe plate 66 of FIG. 3, where it is identified, for purposes of illustration by the number 99(*a*).

Moveable boot carrier 100 consist of boot mounting plate 101, retaining plate 102, and vertical guide member 103.

The vertical distance between the horizontal lower face of boot mounting plate 101 and the horizontal top face of retaining plate 102 is greater than the thickness of foot plate 98, thus a limited amount of vertical motion of moveable boot carrier 100 relative to foot support member 95 is permitted.

The horizontal length of slot 99 is greater than the corresponding horizontal length of vertical guide member 103, thus longitudinal motion of moveable boot carrier 100 relative to foot support member 95 is permitted.

The thickness of vertical guide member 103 is slightly less than the width of slot 99; therefore, sliding motion of vertical guide member 103 in slot 99 is permitted. Because this difference in width is slight, the parallel alignment of boot mounting plate 101 in respect to foot plate 98 is maintained.

When a person is using my skiing teaching machine and skiing simulator that is equipped to permit "change of lead" and lifting of either foot, by means of the mechanisms shown by FIGS. 12, 13, 14, 15 it will be necessary that his ski boot or shoe be attached to boot mounting plate 101. In FIGS. 12, 13, 14, and 15, I have illustrated a means for attaching a ski boot or shoe to boot mounting plate 101. Parts 104 and 105 serve to attach the user's boot to boot mounting plate 101. Part 104 is a heel clamp and part 105 is a toe clamp. These parts serve the same purpose as do parts 32(*a*) and (*b*), 33 and 48 of FIG. 3. It will be seen by a person knowledgeable about skiing that parts 104 and 105 serve the function of a "ski binding."

The foot support member 95 shown in FIGS. 12, 13, 14, and 15 may serve for the right foot of the user of my skiing teaching machine and skiing simulator. A similar set of elements will serve for the left foot of the user.

In the foregoing description, the words boot and foot have been used. It is to be understood that the use of the word boot should not mean that shoes or slippers or any other footwear worn by a person while using my machine are to be excluded from my invention. It is also to be understood that a person using my machine might not be wearing any type of footwear, but might be barefooted. It is intended that the concept of my invention includes the use of my invention by a person while wearing any kind of footwear or even while being without footwear.

In my invention the level of a person's boot sole is offset below the horizontal axis from which is suspended the boot support surface. Thus, I have created a cooperative relationship of the components of the machine which have a synergistic effect which enhances the sensations of skiing as compared with previous skiing simulating machines.

While a particular preferred embodiment has been described herein, it will be understood by those skilled in the art that changes in form and details may be made within the spirit and scope of this invention.

I claim as my invention:

1. An exercising and skiing simulating machine of the type which includes a substantially horizontal rotating platform and two boot support surfaces independently rotatably suspended therefrom by horizontal front to rear axes and by vertical axes means, further comprising the improvement of:

vertical downward offset of the boot support surfaces relative to the said horizontal front to rear axes by a distance equal approximately to the vertical distance from the boot sole to the ankle joint of a person.

2. An exercising and skiing simulating machine of the type having a floor supported frame, a substantially horizontal rotatable platform supported by the frame, vertical pivots attached to the platform, arms pivotally supported by the pivots and boot support surfaces suspended from the arms by horizontal front to rear axes further comprising the improvement of:

adjustable support means for attaching the pivots to the platform; and offsetting of the boot support surfaces vertically downward relative to the horizontal front to rear axes by a distance equal to the approximate distance from the boot sole to the ankle joint of a person.

3. An exercising and skiing simulating machine comprising a frame which stands on the floor, a substantially horizontal rotatable platform, supported by the frame, vertical pivots adjustably attached to the platform, arms rotatably connected to the pivots, boot support surfaces suspended from the arms by horizontal front to rear axes and being offset below the level of the horizontal front to rear axes by a distance of more than one-half inch and less than ten inches.

4. A machine in accordance with claims 1, 2 or 3 further comprising moveable foot carriers which are moveably connected with the boot support surfaces for planear motion relative thereto in a planes that are perpendicular to the boot support surfaces.

5. A machine according to claims 2 or 3 further comprising mechanical biasing means for applying forces to the arms causing them to tend to rotate around the pivot.

6. A machine according to claims 2 or 3, further comprising means for adjustably inclining the substantially horizontal rotatable platform.

7. A machine according to claims 2 or 3, further comprising means for locking the rotatable platform from rotating in a selected one of a plurality of positions.

8. A machine according to claims 1 or 3, further comprising means for locking the arms for rotating around the vertical pivots in selected ones of a plurality of positions.

9. A machine according to claims 1 or 3, further comprising means for securely attaching the boots of a person to the boot support surfaces.

10. A machine according to claims 2 or 3, further comprising padded frame means.

11. A machine according to claims 2 or 3, further comprising a frame constructed for supporting the hands of a person using the machine.

12. A machine according to claims 2 or 3, further comprising sensing means arranged for sensing particular positions of the body of a person using the machine.

13. A machine according to claims 2 or 3, further comprising means for stopping the rotation of the rotating platform at limiting positions.

14. A machine according to claim 13 further comprising cushioning means incorporated into the means for stopping the rotation of the platform at limiting positions.

15. An exercising and skiing simulating machine comprising a floor mounted frame supporting a substantially horizontal rotating platform and vertical pivots adjustably attached to the platform and boot support surfaces rotatably suspended by horizontal front to rear and vertical axes from the pivots with the boot support surfaces being offset downward in relation to the said horizontal front to rear axes by distances equal to approximately the vertical distance from the boot sole to the ankle joint of a person.

16. An exercising machine and skiing teaching machine comprising:

a frame which stands on the floor;

a substantially vertical axis of rotation defined by a vertical spindle tiltably adjustably attached to the frame;

a pair of hand rails as integral parts of the frame;

a horizontal rotating platform supported by the vertical spindle to rotate around the substantially vertical axis of rotation;

a pair of rotation limiting stopping means attached to the horizontal rotating platform;

a pair of vertical pivots attached adjustably to the horizontal rotating platform;

a pair of horizontal arms independently rotatably mounted respectively on the horizontal rotating platform by the pair of vertical pivots;

a pair of horizontal front to rear axes, defined by the pair of horizontal arms;

a pair of boot support members respectively each being rotatably mounted on one of the horizontal arms by means of the horizontal front to rear axes;

a pair of moveable boot carriers respectively supported by the pair of boot support members in a manner that permits limited vertical motion and horizontal motion of each moveable boot carrier with respect to its related boot support member parallel with the plane that contains the related horizontal front to rear axes and which is perpendicular to the related boot support surface;

a pair of boot support surfaces, each being a part respectively of one of the moveable boot carriers and each being displaced vertically downward with respect to its corresponding horizontal front to rear axis a distance approximately equal to the ankle height of a person which is, more specifically, a distance of between three and one-half inches and six inches;

a means to securely attach each of the user's boots, shoes or feet to a respective moveable boot carrier.

* * * * *